US005165249A

United States Patent [19]

Thompson

[11] Patent Number: 5,165,249

[45] Date of Patent: Nov. 24, 1992

[54] COOL/HEAT PUMP ROOM AIR CONDITIONER CONTROL CIRCUITS

[75] Inventor: Christopher M. Thompson, Nashville, Tenn.

[73] Assignee: Whirlpool Corporation, Benton Harbor, Mich.

[21] Appl. No.: 825,053

[22] Filed: Jan. 24, 1992

[51] Int. Cl.[5] ..... F25D 21/06

[52] U.S. Cl. ..... 62/156; 62/160; 62/277; 318/112

[58] Field of Search ..... 318/112, 53; 62/180, 62/160, 156, 277

[56] References Cited

U.S. PATENT DOCUMENTS

| | | | |
|---|---|---|---|
| 2,242,370 | 3/1941 | Packer | 318/112 |
| 2,782,351 | 2/1957 | Suhr | 318/103 |
| 3,045,159 | 7/1962 | Levy et al. | 318/103 |
| 3,146,387 | 8/1964 | Levy et al. | 318/112 |
| 3,385,077 | 5/1968 | Marsteller | 62/180 |
| 3,546,895 | 12/1970 | Jacobs | 62/277 |
| 3,852,648 | 12/1974 | Barry et al. | 62/230 X |

*Primary Examiner*—William E. Wayner

[57] ABSTRACT

A control circuit for a cool/heat pump in which two separate motors are utilized, each with a main winding and an auxiliary winding. A single dual rated capacitor is provided in series with the auxiliary windings and an alternating current line and a selectively operative switch, which may be in the form of a thermostat, is provided in series between one of the alternating current lines and a main winding of one of the motors to selectively terminate power to that main winding while maintaining power to both auxiliary windings and the main winding of the other motor. Such a control circuit allows a de-icing operation with the cool/heat pump working in a heating mode, without blowing cold air into the room which is to be heated.

19 Claims, 4 Drawing Sheets

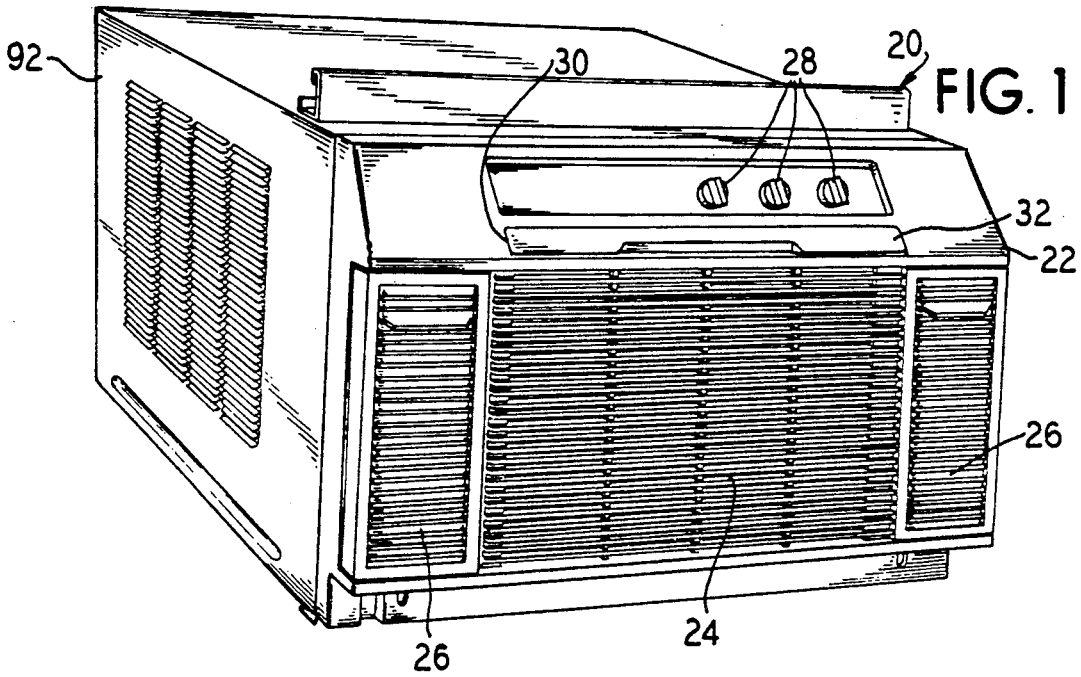
FIG. 1
FIG. 5
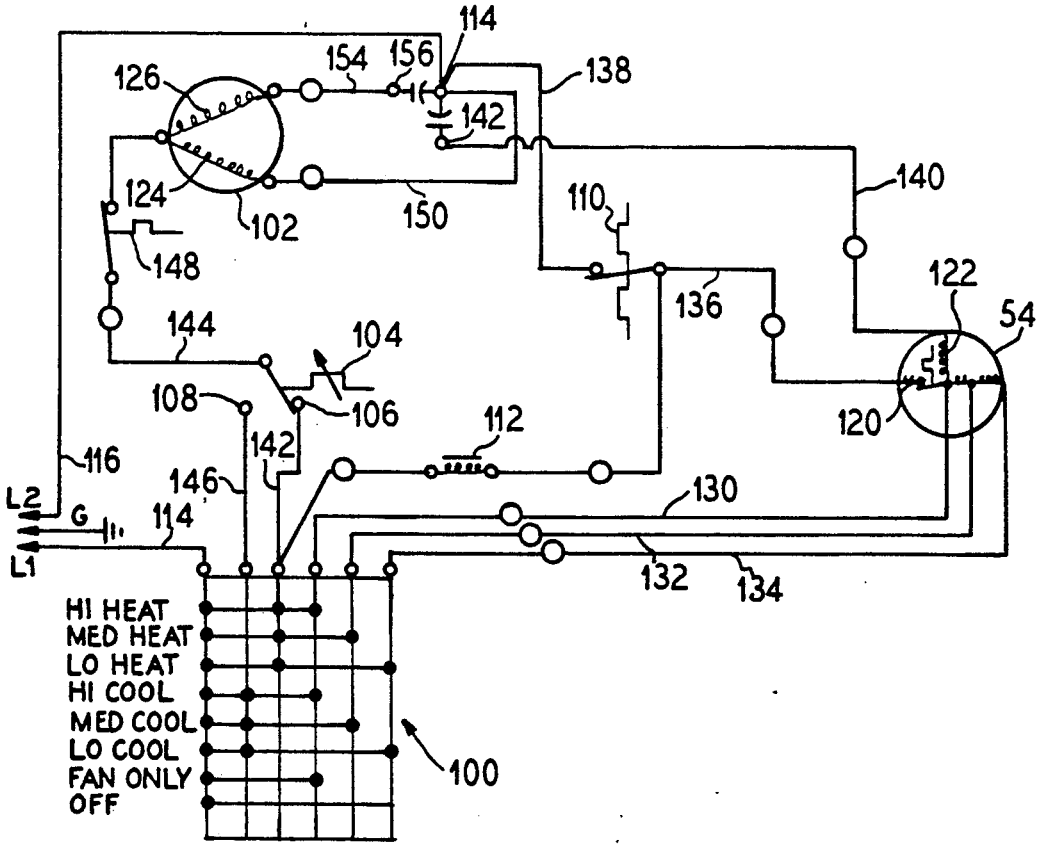

COOL/HEAT PUMP ROOM AIR CONDITIONER CONTROL CIRCUITS

BACKGROUND OF THE INVENTION

The present invention relates to a control circuit and more specifically to a control circuit for a cool/heat pump room air conditioner.

Room air conditioners are well known and are of the type that generally fit in a window or in a sleeved opening formed through the wall of a room. Most such room air conditioners utilize a fluid refrigerant which is caused to alternately expand and condense to provide the desired cooling effect inside the room and to expel heat outside of the room. The refrigerant flows through a system which includes an evaporator where liquid refrigerant is permitted to evaporate thereby cooling a coil surface of the evaporator in order to extract heat from air within the room. A fan is used to cause room air to flow over the coil of the evaporator. The refrigerant then flows to the compressor where it is returned to a high pressure gas state. The refrigerant then flows to a condenser, generally positioned outside of the room wherein the refrigerant vapor condenses and gives off heat. Generally a fan is also provided on the condenser side to provide a flow of outside air over the condenser coil to remove heat therefrom. Refrigerant then flows to an expansion device where it is turned to a low pressure liquid state before flowing again to the evaporator.

It is known that by reversing the flow through the system, the air conditioner can act as a heat pump to draw heat from exterior of the room and to provide that heat to the interior of the room. In such an arrangement the refrigerant flow is reversed and what was the evaporator now acts as the condenser to release heat and what was the condenser now acts as the evaporator to absorb heat from the surrounding air.

Control systems for room air conditioners are well known and in such control circuits generally include a switch for powering a compressor motor and a fan motor as well as sometimes controlling other components.

Generally the type of motors utilized in such air conditioners have both a main winding and an auxiliary winding with capacitors in series with the auxiliary winding. Control circuits which have been provided for such air conditioning units and motors are disclosed in the following U.S. Pat. No(s). 2,242,370; 2,782,351; 3,045,159; 3,146,387; 3,385,077; and 3,852,648. Such circuits are limited to air conditioner units, however, and do not appear to provide the necessary controls for heat pump operation.

The above listed patents describe various types of control circuits and including circuits in which a single, dual rated capacitor is used in series with each of the two motor auxiliary windings.

Applicant has determined that in the application where such a room air conditioner is also being utilized as a heat pump, additional considerations arise over those necessary for controlling a room air conditioner, including the need to provide a de-icing circuit for the evaporator when the unit is being operated as a heat pump and, during such operation, the refrigerant flow must be reversed so as to provide a warming to the evaporator coil. Since the heat pump is generally being used to heat the interior space, it would be detrimental for the interior fan to run during the de-icing operation because during the de-icing operation the interior coil is acting as an evaporator and would thus result in cold air being blown from the evaporator coils. Therefore, it would be an improvement in the art for there to be provided a control circuit for a cool/heat pump room air conditioner which will control the various components with minimum number of parts, yet provide the desired heating and cooling and prevent undesired cooling effect within the room during a de-icing operation.

SUMMARY OF THE INVENTION

The present invention provides a control circuit for a cool/heat pump room air conditioner which utilizes a minimum number of circuit parts, including only a single dual rated capacitor to control both the compressor motor and the fan motor, the control circuit providing means for terminating power to the main winding of one of the motors while maintaining power to both the auxiliary windings and the other main winding of the second motor. The means for terminating power to one of the main windings is a thermostat switch which also controls a solenoid to provide a reversing of the refrigerant flow through the cool/heat pump room air conditioner system. Thus, when the thermostat detects a condition which requires de-icing of the evaporator, the switch opens, terminating power to the fan motor and the solenoid, thus reversing the flow of refrigerant causing the evaporator to now function as a condenser and the interior condenser to operate as an evaporator. Thus, the exterior evaporator, now operating as a condenser, gives off heat to warm the coils and to effect a de-icing of that heat exchanger and, as the refrigerant flows through the interior heat exchanger, no fan is operated and therefore the cooling effect of the interior heat exchanger is kept at a minimum.

BRIEF DESCRIPTION OF THE DRAWINGS

FIG. 1 is a perspective view of a cool/heat pump room air conditioner embodying the principles of the present invention.

FIG. 5 is an electrical schematic of the control circuit for the cool/heat pump.

DESCRIPTION OF THE PREFERRED EMBODIMENTS

Figure 2:
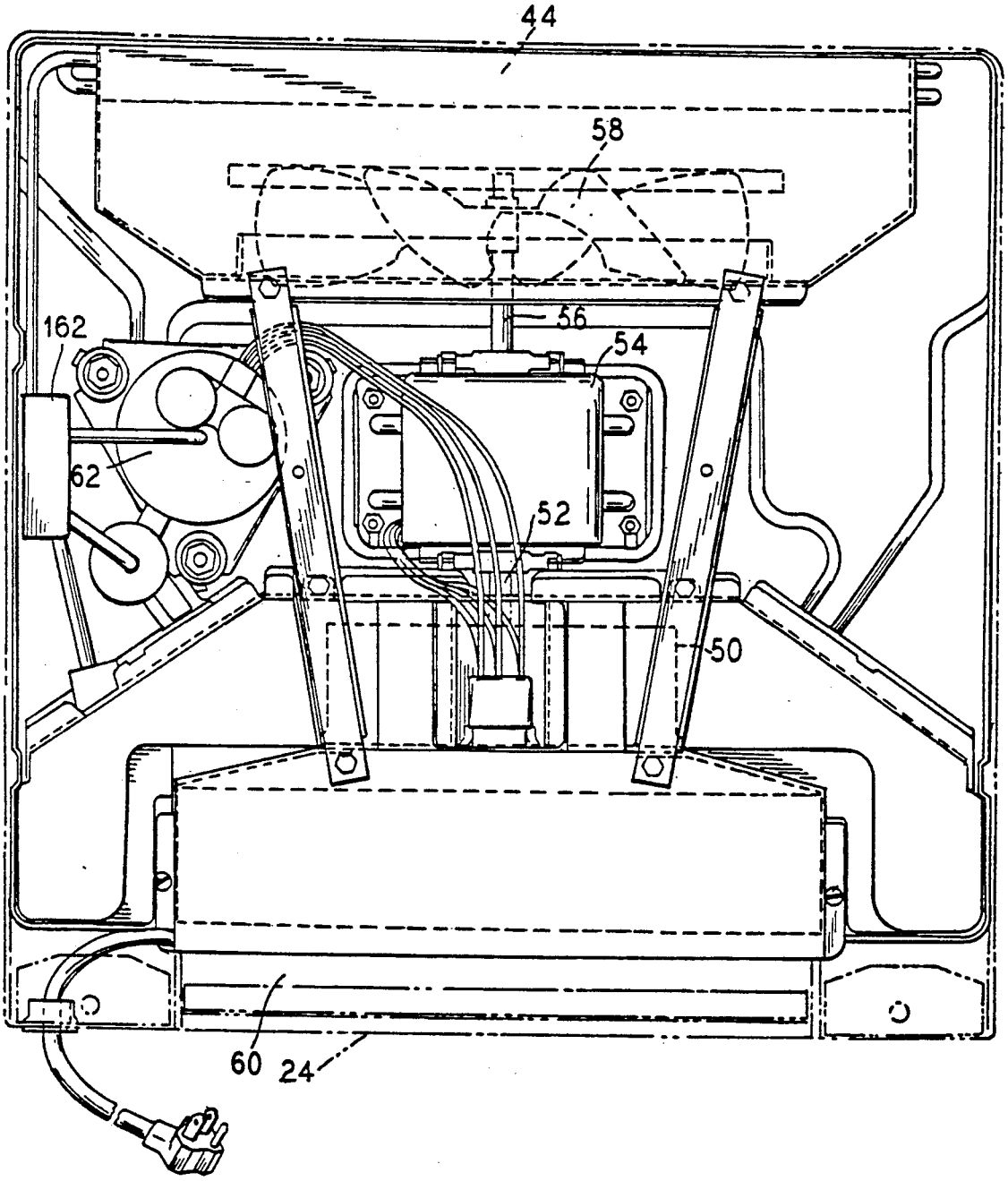
FIG. 2 is a top elevational view of the cool/heat pump of FIG. 1 with the cover removed.

FIG. 1 illustrates a cool/heat pump room air conditioner generally at 20 which embodies the principles of the present invention. Although the present invention may be utilized in other circuits where two motors are to be controlled, it has particular utility in a cool/heat pump room air conditioner and will be described in that environment.

The cool/heat pump room air conditioner has a front panel 22 which faces the interior of a room to be cooled or heated when the cool/heat pump unit is placed in an open window or in a through the wall sleeve. A central portion 24 of the panel constitutes an air inlet grill through which air flows into a portion of the cool/heat pump unit. The air is returned to the room through a pair of laterally spaced outlet grills 26.

A plurality of controls 28 are provided on a control panel area above the inlet grill. Positioned above the inlet grill 24 and below the controls is a slot 30 within which is received an air filter element 32.

Figure 3:
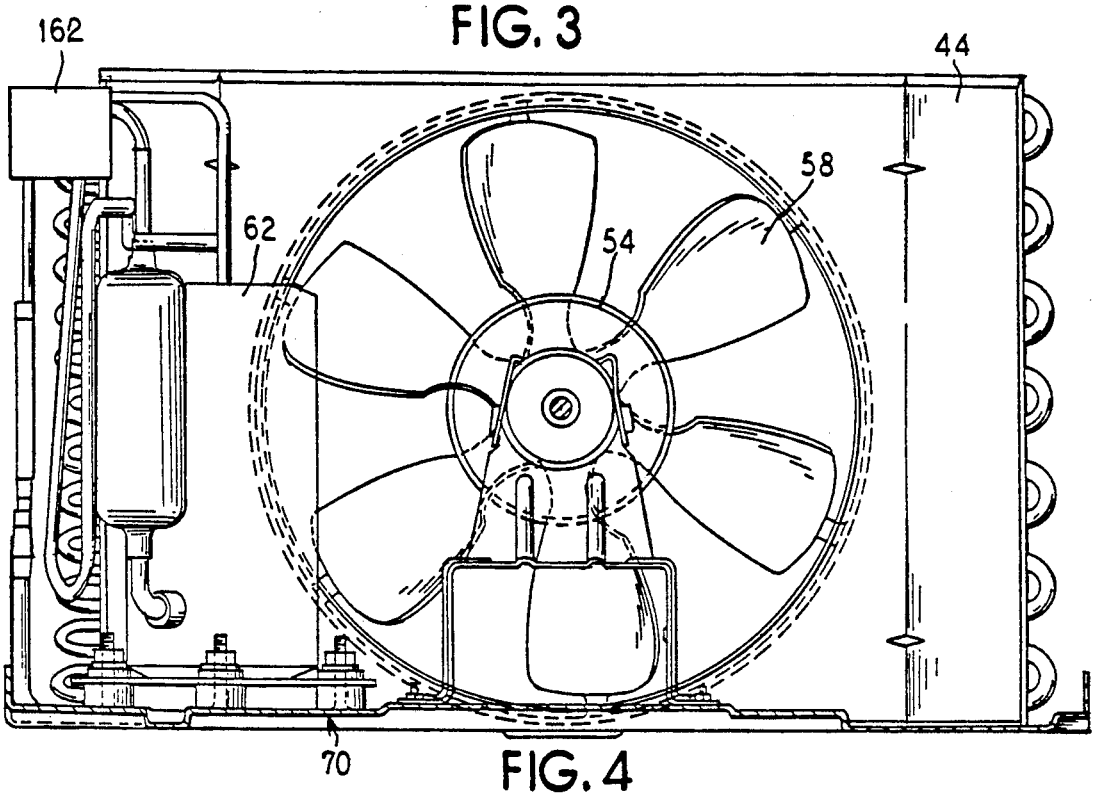
FIG. 3 is a sectional view through a central portion of the cool heat pump showing the "exterior" side of the unit.
Figure 4:
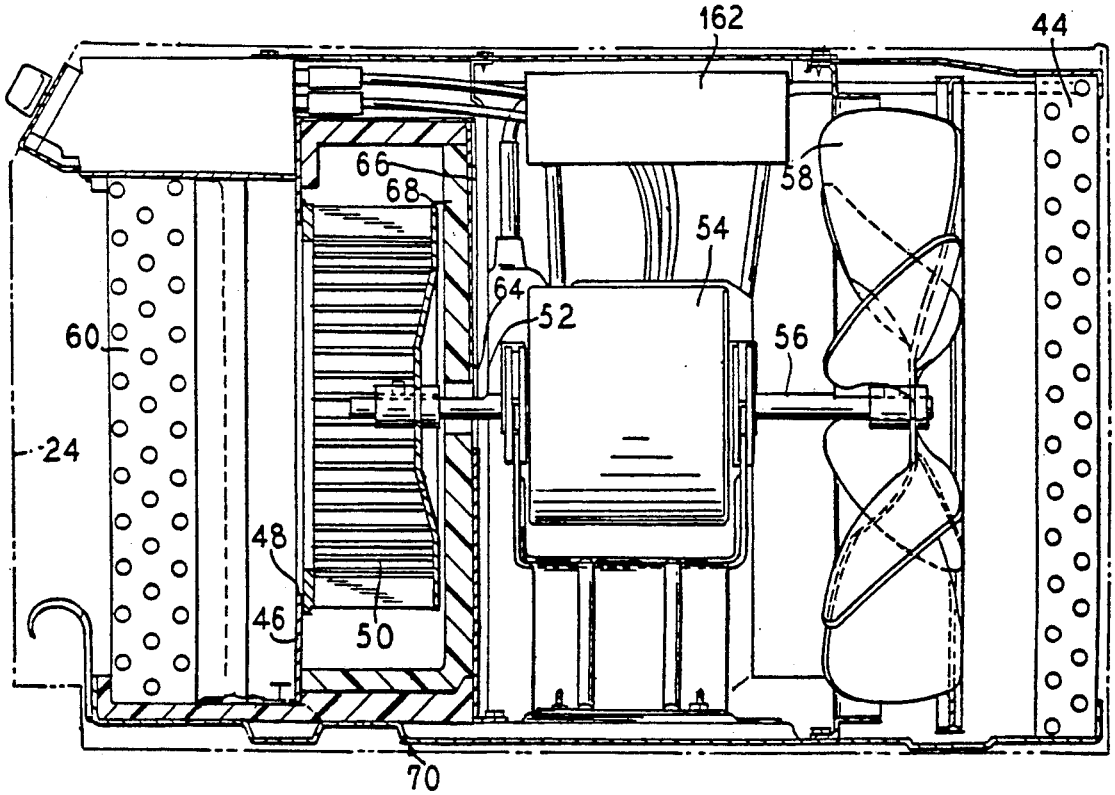
FIG. 4 is a side sectional view of the cool/heat pump of FIG. 1.

The internal components of the cool/heat pump unit are shown in greater detail in FIGS. 2–4. Directly behind the front inlet grill is located a first heat exchange unit 60 which is mounted within a sheet metal shroud or housing 46. The housing 46 has central rear opening 48 which is positioned directly in front of an air moving device, preferably a blower wheel. The blower wheel 50 is mounted on a forwardly extending drive shaft 52 of an electric motor 54. The motor 54 also has a rearwardly extending drive shaft 56 to which a fan blade 58 is mounted. The drive shafts 52, 56 extend along the center line of the cool/heat pump unit. Directly behind the fan blade is a second heat exchanger 44. A compressor 62 is provided as is known in the art.

The forwardly extending drive shaft 52 extends through an opening 64 in a barrier wall 66 provided between the blower wheel 50 and the motor 52. The barrier wall 66 separates the two heat exchange units 44, 60 to prevent a short circuiting of the thermal effects generated by the unit. A barrier of expanded polystyrene 68 is provided along the barrier wall 66 which provides an insulation against heat transfer.

A base pan assembly 70 is provided as a mounting platform for a large number of the components of the cool/heat pump unit.

A control circuit for the cool/heat pump is illustrated in FIG. 5. A control switch 100, which may be one of the controls 28 on the front panel of the unit shown in FIG. 1 is provided for the user to select an operating mode for the cool/heat pump. The illustrated operating modes include three speeds each of heating and cooling, a fan only operating mode and an off mode. Other components of the circuit include the fan motor 54, a motor 102 for the compressor 62, an adjustable thermostat 104 having an upper temperature contact 106 and a lower temperature contact 108, a de-icer thermostat 110, a solenoid 112 and a single dual rated capacitor 114. Single phase alternating current is provided to the circuit on a pair of lines 114, 116. Fan motor 54 has a main winding 120 and an auxiliary winding 122 and the compressor motor 102 also has a main winding 124 and an auxiliary winding 126.

Alternating current line 114 is connected to the main and auxiliary windings 120, 122, 124, 126 through the control switch 100 and appropriate contacts therein. For the connection to the fan motor auxiliary winding 122, the alternating current line 114 is connected to a selected one of lines 130, 132, 134 depending upon whether the fan is to be run at a high, medium or low speed. Lines 130, 132 and 134 are connected to different taps in the auxiliary winding 122 of the fan motor. The main winding 120 is then connected through the de-icer thermostat 110 in series with lines 136 and 138 to the second line 116 of the alternating current supply. The auxiliary winding 122 is connected through line 140 to a terminal 142 of the capacitor 114. A central terminal of the capacitor 114 in turn is connected to the second alternating current line 116.

The compressor motor 102 main winding 124 is connected to the first alternating current line 114 through appropriate contacts in the control switch 100. During a heating mode of operation the connection from line 114 to the main winding is through line 142 and upper temperature contact 106 in line 144. During cooling operation line 114 is connected to the main winding 124 through line 146, lower temperature contact 108 and line 144. An overload fuse 148 is provided in line 144 to protect the compressor motor 102. The main winding 124 is then connected through line 150 to alternating current line 116. The compressor auxiliary winding 126 is connected to line 114 in precisely the same manner as the main winding. The auxiliary winding 126 is then connected through line 154 to a second terminal 156 of capacitor 114 which, again, is then connected directly to alternating current line 116 at its center terminal.

Figure 6:
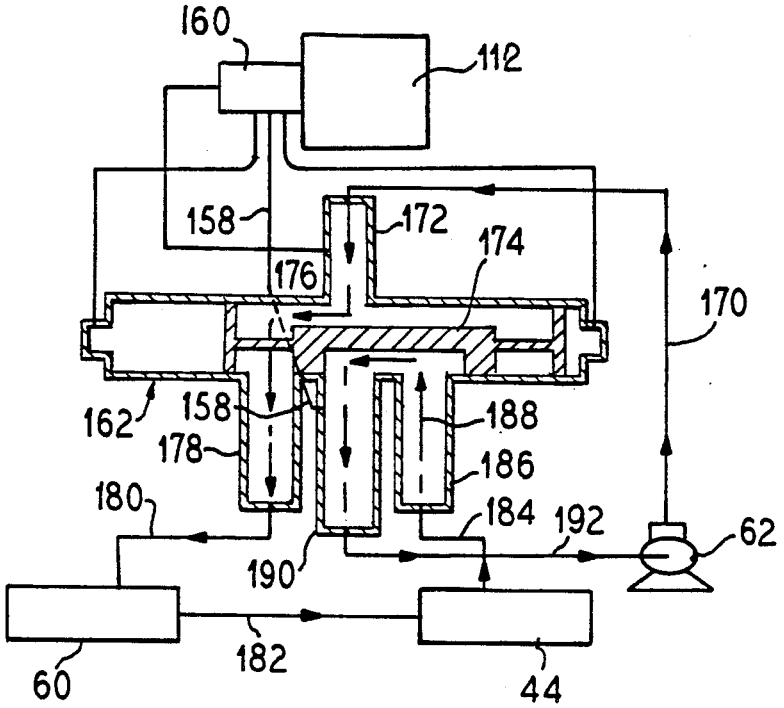
FIG. 6 is a schematic diagram of the refrigerant system with a reversing valve in a heating position.
Figure 7:
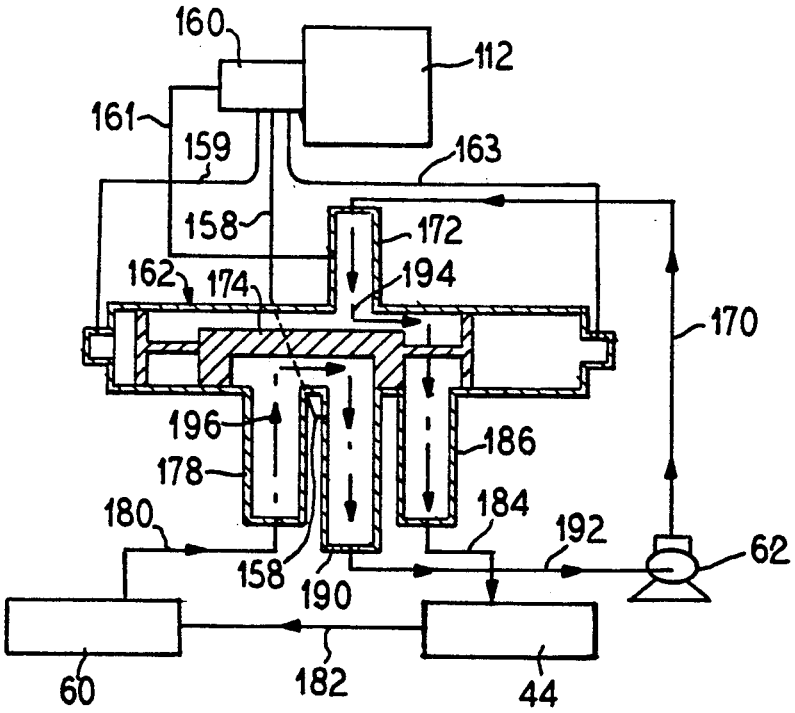
FIG. 7 is a schematic illustration of the refrigerant system with a reversing valve shown in a cooling position.

Solenoid 112 operates a pilot valve 160 as best seen in FIGS. 6 and 7. The pilot valve in turn is connected to a main valve 162 which provides for reversing flow of refrigerant through the system. Specifically, the compressor 62 is utilized to compress a refrigerant and to pump it, under high pressure, through line 170. Line 170 connects to an inlet port 172 on valve 162. In the position of valve 162 in FIG. 6 where a valve slide member 174 has been moved to a right hand position by the pilot valve 160, the refrigerant follows a flow path 176 to an outlet port 178 from where it flows through line 180 to heat exchange unit 60. In this arrangement heat exchange unit 60 acts as a condenser to reject heat to the surrounding air. The refrigerant condenses from a gas to a liquid in heat exchange unit 60.

From heat exchange unit 60 the refrigerant flows through line 182 to the second heat exchange unit 44 which, in this operating mode, acts as an evaporator where the now liquid refrigerant evaporates to a gas and absorbs heat from the surrounding air. From the second heat exchange unit 44 the now gaseous refrigerant flows through line 184 to a second inlet port 186 of valve unit 162 and along a flow path 188 to a second outlet port 190 of the valve member 162. From outlet port 190 the low pressure gaseous refrigerant flows through line 192 to a suction inlet on the compressor 62.

In a second position of solenoid 112, the pilot valve 160 is moved to a second position thus permitting its suction connection line 158 to be connected with line 159, and its pressure connection line 161 to be connected with line 163 to draw the slide member 174 to a left most position. Again, the compressor 62 operates in the same fashion and causes a flow of high pressure gaseous refrigerant through line 170 to inlet port 172. The refrigerant now flows on flow path 194 to what is now an outlet port 186 and through line 184 to the heat exchange unit 44. Now heat exchange unit 44 acts as a condenser rejecting heat to the surrounding atmosphere. The now liquid refrigerant flows through line 182 to the second heat exchange unit 60 which, in this mode of operation, functions as an evaporator to return the refrigerant to a gaseous state. The now low pressure liquid flows through line 180 through what is now an inlet port 178, along flow path 196 to outlet port 190, and through line 192 to again return to the suction side of the compressor 62.

In the heating mode selected by selector switch 100, the solenoid 112 is energized and thus causes the slide member 174 of valve 162 to move to the right most position as shown in FIG. 6. In this condition the heat exchange unit 60, which is positioned towards the interior of the room, acts as the condenser and gives off heat to the room. Heat is absorbed into the refrigerant in heat exchange unit 44 which is positioned on the exterior of the room.

During certain operating conditions it is possible for the coils of the exterior heat exchange unit 44 to become coated with ice due to condensation of moisture in the outside air on to the coils which have a temperature below freezing. This condition is not desirable in that it severely impairs the efficiency of the outside heat exchange unit 44. Therefore, the de-icer thermostat 110 is provided to detect such icing condition, as is known in the art.

When such an icing condition is detected, the thermostat 110 causes a switch connection to open thereby de-energizing the solenoid 112 causing the slide member 174 to move to the position shown in FIG. 7. In this position the outside heat exchange unit 44 now acts as the condenser whereby the heat given off by the refrigerant condensing causes the ice on the heat exchanger coils to melt. Since this de-icing operation occurs while the interior of the room is to be heated, it is not desirable to have the fan motor 54 operating (which would blow cool air into the room), although it is required to have the compressor motor 102 operating. Therefore, the de-icer thermostat 110 is also positioned in series with the main winding 120 of the fan motor 54. Thus, when the de-icer thermostat detects an icing condition, the main winding of the fan motor is de-energized. The main and auxiliary windings 124, 126 of the compressor motor 102 continue to be energized as does the auxiliary winding 122 of the fan motor. The energization of the fan motor auxiliary winding is not sufficient to cause the fan motor to operate, but it does provide the benefit of generating heat in the fan motor (which is positioned on the exterior (cold) side of barrier wall 66) thus assisting in the start up of the fan motor when the unit is returned to the heating mode. Since the start up of a cold motor is significantly harder and more energy consumptive than start up of a warm motor, the continued energization of the auxiliary winding to the fan motor provides a real benefit.

The use of a single dual rated capacitor 114 in the circuit significantly reduces the complexity of the circuit and reduces its cost in the reduction of components and in assembly time. During the cooling mode selected by selector switch 100 the solenoid 112 is not energized and thus operation and position of valve 162 is that shown in FIG. 7. During such operation, however, power is supplied to the fan motor main winding 120.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

The embodiments of the invention in which an exclusive property or privilege is claimed are defined as follows:

1. A cool/heat pump operated by alternating current supplied on two lines comprising:

a compressor driven by an electric motor with a main winding and an auxiliary winding;

an evaporator having a fluid flow connection to said compressor for a refrigerant fluid to flow from said compressor to said evaporator to absorb heat from the atmosphere surrounding said evaporator;

a condenser having a fluid flow path connection to said evaporator for said refrigerant fluid to flow from said evaporator to said condenser to release heat to the atmosphere surrounding said evaporator and a fluid flow path connection to return said refrigerant to said compressor;

a fan driven by an electric motor with a main winding and an auxiliary winding for causing a flow of atmospheric air over at least one of said evaporator and condenser;

a selector switch for a user to use in selecting an operating mode for the cool/heat pump, from the group comprising a heating mode and a cooling mode;

a temperature control thermostat operatively connected to a first of said alternating current lines to selectively energize said compressor motor in both said heating mode and said cooling mode;

a single dual rated capacitor connected between a second of said alternating current lines and both said fan motor auxiliary winding and said compressor motor auxiliary winding;

a solenoid for use in selectively changing the flow direction of said refrigerant fluid in said flow path so as to cause said evaporator and condenser to change their function to that of the other, said solenoid being operatively connected to said selector switch to provide for selective energization thereof;

a de-icer thermostat operatively connected between said fan motor main winding and said second line so as to terminate power to said fan motor main winding when said de-icing operation is in effect;

whereby, said single capacitor can be used in conjunction with two separate motors, yet allowing only one of said motors to run during certain conditions, while maintaining full power to said other motor in said cool/heat pump.

2. A cool/heat pump according to claim 1, wherein said selector switch is in series between said second line and said fan motor auxiliary winding.

3. A cool/heat pump according to claim 1, wherein said solenoid is connected to operate a valve in said fluid flow connections to cause a change in direction of said fluid flow.

4. A cool/heat pump according to claim 1, wherein said selector switch has switch positions to provide an operating mode of energizing only the fan motor to the exclusion of the compressor motor.

5. A cool/heat pump according to claim 1, wherein said solenoid is connected in series between said de-icer thermostat and said second line such that when said thermostat terminates the power connection to said fan motor main winding it also terminates power to said solenoid.

6. A cool/heat pump according to claim 5, wherein said solenoid is normally energized when said selector switch is in said heating mode so that when said de-icer thermostat terminates power to said thermostat it also causes said fluid flow direction to change.

7. A control circuit for a cool/heat pump, said control circuit powered by alternating currents supplied on two lines and said cool/heat pump using a refrigerant fluid, wherein said cool/heat pump comprises means for compressing said fluid, said means having an inlet and an outlet, a first heat exchanger having a fluid flow connection to said outlet for said fluid to flow to said first heat exchanger, a second heat exchanger having a fluid flow path connection to said first heat exchanger for said refrigerant fluid to flow from said first heat exchanger to said second heat exchanger and a fluid flow path connection to return said refrigerant to said inlet, a fan for causing a flow of atmospheric air over at least one of said two heat exchangers, said control circuit comprising:

an electric motor with a main winding and an auxiliary winding for driving said means for compressing said fluid;

a second electric motor with a main winding and an auxiliary winding for driving said fan;

a single dual rated capacitor connected between a second of said lines and both said fan motor auxiliary winding and said compressor motor auxiliary winding;

circuit means for selectively changing a flow direction of said refrigerant fluid in said flow path; and circuit means for selectively terminating power to said fan motor main winding without also terminating power to said compressor motor.

8. A control circuit according to claim 7, wherein said first heat exchanger is a condenser.

9. A control circuit according to claim 7, wherein said second motor drives two fans to cause a flow of atmospheric air over both of said heat exchangers.

10. A control circuit according to claim 7, wherein said circuit means for selectively changing said fluid flow direction comprises a solenoid selectively controlled by said means for selectively terminating power to said fan motor.

11. A control circuit according to claim 7, wherein said circuit means for selectively terminating power to said fan motor comprises a thermostat.

12. A control circuit according to claim 7, wherein said thermostat senses the temperature associated with said first heat exchanger.

13. A control circuit according to claim 7, including a selector switch for a user to use in selecting an operating mode for the cool/heat pump, from the group comprising a heating mode and a cooling mode.

14. A control circuit according to claim 10, wherein said solenoid is connected to operate a valve in said fluid flow connection to cause a change in direction of said fluid flow.

15. A control circuit according to claim 10, wherein said solenoid is connected in series between said de-icer thermostat and said second line such that when said thermostat terminates the power connection to said fan motor main winding, it also terminates power to said solenoid.

16. A control circuit according to claim 15, wherein said solenoid is normally energized when said selector switch is in said heating mode so that when said de-icer thermostat terminates power to said thermostat it also causes said fluid flow direction to change.

17. An electric circuit comprising:

two electric motors, each having a main winding and an auxiliary winding;

one dual capacitor having a central connection and two terminal connections;

a pair of alternating current lines;

a first one of said lines being connected to said main and auxiliary windings and a second of said lines being connected to said central connection;

said two terminal connections being connected to said first line in series with the respective auxiliary windings of said two motors; and selectively operative switch means in series between said second line and one of said main windings to terminate power to said one main winding, while maintaining power to both auxiliary windings and the other main winding.

18. A circuit according to claim 17, wherein said circuit is used in a cool/heat pump having a fan and a compressor and one of said motors which has said one of said main windings drives said fan while the other of said motor drives said compressor.

19. A circuit according to claim 18, wherein said cool/heat pump further comprises an evaporator and said switch means comprises a thermostat associated with said evaporator.

* * * * *